United States Patent [19]

Duhl et al.

[11] 4,192,160

[45] Mar. 11, 1980

[54] FABRIC AND APPARATUS AND METHOD FOR MAKING SAME

[75] Inventors: Daniel Duhl, New York, N.Y.; Denton B. Wall, Tarboro, N.C.

[73] Assignee: Polylok Corporation, New York, N.Y.

[21] Appl. No.: 941,258

[22] Filed: Sep. 11, 1978

Related U.S. Application Data

[62] Division of Ser. No. 810,874, Jun. 28, 1977, Pat. No. 4,144,727.

[51] Int. Cl.[2] ..... D04B 23/00; D04B 27/00

[52] U.S. Cl. ..... 66/207; 66/192

[58] Field of Search ..... 66/169–171, 66/85 A, 84 A, 190–195; 112/439, 429, 430

[56] References Cited

U.S. PATENT DOCUMENTS

| | | | |
|---|---|---|---|
| 3,279,221 | 10/1966 | Gliksmann | 66/192 |
| 3,567,565 | 3/1971 | Jones et al. | 66/192 |
| 3,672,187 | 6/1972 | Simpson | 66/192 |

*Primary Examiner*—Ronald Feldbaum
*Attorney, Agent, or Firm*—Polylok Corporation

[57] ABSTRACT

A fabric is produced in a stitch-through type machine such as a Malimo maching using the apparatus and method of the invention which has at least two warp yarn design elements laid on a flexible substrate (e.g., a layer of textile filling elements) along rectilinear or non-rectilinear paths and on which a plurality of adjacent design elements are twisted (e.g., symmetrically at 180° per twist) in an aesthetically pleasing configuration at spaced intervals along the warp direction. The design elements are bound to the substrate by knitting thread which forms a multiplicity of warpwise loop chains (e.g., a half-tricot stitch) to secure the substrate and design elements against relative displacement and to form thereby an integrated fabric structure. The apparatus for guiding the warp yarn design elements onto the flexible substrate in a twisted and aesthetically pleasing configuration at spaced intervals along the warp direction includes at least one shaft rotatable about its longitudinal axis to which is joined a guide bar having a number of spaced-apart warp yarn guides. The apparatus is adapted to be mounted on the machine for rotation of the shaft about its axis in synchronization with reciprocal linear movement of the shaft along said axis. In the present method of producing the fabric, a plurality of adjacent design elements are twisted at spaced time intervals by means of the herein disclosed apparatus at a location upstream from the point at which the substrate and design elements are joined by the knitting thread.

25 Claims, 9 Drawing Figures

FABRIC AND APPARATUS AND METHOD FOR MAKING SAME

This is a division of application Ser. No. 810,874, filed June 28, 1977 now U.S. Pat. No. 4,144,727.

BACKGROUND OF THE INVENTION

This invention relates to fabrics which are produced on stitch-through type machines such as a Malimo machine. More particularly, it relates to an improved Malimo-type fabric and to an apparatus and method used in making it wherein the improvement resides in the configuration of certain yarn components of the fabric which is useful among other things in decorative applications such as draperies.

Malimo fabrics typically comprise a layer of substantially parallel warp yarn elements or ends on a flexible substrate such as a layer of substantially parallel textile filling elements or ends. The warp yarn elements are affixed to the flexible substrate by laying one on top of the other and joining them into an integrated structure by means of relatively fine knitting threads. In the case where the flexible substrate is a layer of textile filling elements, a more or less open mesh fabric can be obtained by controlling the spacing between the individual warp yarn elements and/or the individual filling elements. This and other "stitch-through" type fabric structures can be obtained on machines of the "Malimo" type, using methods and equipment described in U.S. Pat. Nos. 2,890,579; 3,030,786; Re. 25,749; 3,253,426; 3,274,806; 3,279,221; 3,309,900; 3,389,583; 3,392,078; 3,440,840; 3,452,561; 3,457,738; 3,460,599; 3,540,238; 3,541,812; 3,567,565; and 3,592,025.

The ability to readily mass produce a basic fabric in a variety of patterns is extremely important to the commercial success of the fabric. While fabric can be produced on the "Malimo" machines at a very high rate of speed, much attention has been given to augmenting this desirable feature with design flexibility, not only with respect to the density, gauge, and color combinations of the fabric components, the spacing between them, and the purposeful omission of one or more of such components, but also with respect to the spatial configuration of the warp yarn elements, i.e., the disposition of such elements on the flexible substrate. As described in U.S. Pat. No. 3,672,187 these warp yarn "design elements" can be used to achieve pattern effects by virtue of the non-rectilinear paths which they are caused to follow while being laid on the substrate.

However, a need has existed for Malimo fabrics of still further design flexibility, particularly with respect to the creation of unusual visual effects in which the warp yarn design elements vary in their relative level positions along the length of fabric. Heretofore there has been no means or method by which such an effect could be achieved on Malimo machines at commercial production speeds.

Accordingly, it is an object of the present invention to provide fabrics such as are produced on stitch-through type machines wherein the warp yarn design elements vary in their relative level positions along the length of the fabric.

A further object is to provide apparatus for producing fabrics on stitch-through type machines wherein the warp yarn design elements vary in their relative level positions along the length of fabric.

Yet another object is to provide a method for producing fabrics on stitch-through type machines wherein the warp yarn design elements are caused to vary their relative level positions along the length of the fabric.

These and other objects of the invention as well as a fuller understanding of the advantages thereof can be had by reference to the following detailed description, drawings, and claims.

SUMMARY OF THE INVENTION

The foregoing objects are achieved according to the present invention in the form of an improved fabric made on a stitch-through type machine such as a Malimo machine, i.e., a fabric which is composed of a flexible substrate, at least two warp yarn design elements laid on the substrate in the general warp direction, and knitting thread forming a multiplicity of warp-wise loop chains which bind together into an integrated textile fabric structure the substrate and design elements and which secure the substrate and design elements against relative displacement. The fabric is improved in the sense that it achieves an unusual and heretofore unattainable visual effect of aesthetically pleasing appearance according to the present invention whereby a plurality of adjacent design elements vary in their relative level positions along the length of the fabric by being twisted at spaced intervals along the warp direction.

The adjacent warp yarn design elements which are twisted at spaced intervals along the warp direction of the fabric can be laid on the substrate in the intervals between twists in either mutually contacting relationship or can be spaced apart from one another in the weft direction at any predetermined distance. Desirably, such warp yarn design elements are substantially spaced apart in order to amplify the visual effect of the twist by contrast. The degree of "twist" imparted to the design elements according to the present invention can be any angular amount from greater than 0° C. to 360° although a degree of twist of desirably at least 90° and preferably 180° is necessary in order to maximize the visual effect created by the twist configuration, and to achieve a true twisting or crossing over of the warp yarn design elements as opposed to apparent twisting brought about by proximation of the design elements without an actual crossing over of such elements, which apparent twisting obtains when the degree of twist is less than 90°. In the case of a 180° twist, opposite warp yarn design elements in a group of two or more are caused to exchange places with each other and then return to their original relative positions along the fabric with each alternate twist. In the regions or intervals between the twists , the design elements can be laid on the flexible substrate in a substantially rectilinear or straight line fashion parallel to the warp direction; alternatively, as described hereinbelow, the design elements can be caused to follow non-rectilinear paths in conjunction with their twisted configuration.

The flexible substrate upon which the warp yarn design elements are laid and periodically twisted to form the fabric of the present invention can be a pre-knitted or pre-woven fabric, an elastomeric foam sheet, fibrous batting or any other continuous sheeting, one or more layers of textile filling elements running in a general weft-wise direction with respect to the warp-wise design elements, or any other flexible structure capable of being secured to the design elements with knitting thread according to procedures described in U.S. Pat.

No. 3,672,187 and now familiar to those skilled in the art of stitch-through fabric construction. In the case of fabrics having the open-mesh "home spun" appearance characteristic of casement or drapery fabrics, a flexible substrate in the form of a single layer of textile filling elements is preferred.

The knitting thread used to bind together into an integrated textile fabric structure the warp yarn elements and flexible substrate is applied to these components by means of the mechanical stitching elements conventionally employed on stitch-through type machines. These elements and their mode of operation are well-known to those skilled in the art and include a comb-like sinker bar and comb-like retainer pin bar, which together define an elongated space or work zone for fabric formation between them. The stitching elements include additionally a row of pronged or bearded pointed needles and corresponding closing wires the combination of which is caused to move in a reciprocating fashion through the aforesaid work zone in coaction with a row of knitting thread guides for forming a multiplicity of warpwise knitting thread loop chains. In the usual operation of the machine, alternate loops in each chain are formed with a different knitting thread, and each thread forms a series of warpwise loop chains. The type of loop chain formed can be any type familiar to those skilled in the art, although loop chains of the type characteristic of the well-known half-tricot stitch configuration are preferred because of the normally greater structural integrity imparted to the overall fabric characteristic of the half-tricot stitch knitting thread network.

The fabrics produced in the manner of the present invention employing knitting thread to bind the warp yarn elements and the flexible substrate into an integrated structure have the feature in which the knitting thread pierces the individual design yarn elements and pierces the flexible substrate at a substantial number of random points to further secure the substrate and design elements against relative displacement.

In one embodiment of the fabric of the invention, at least two yarn design elements can be laid on the substrate along non-rectilinear paths in the warp direction and thereby create a design effect which serves to augment symergistically the aesthetically pleasing appearance created by the twisted configuration of the design elements. More particularly, the design elements can include portions of substantial length extending diagonally, relative to the warp direction, along straight lines or curving substantially uniformly. The design elements can be disposed in groups composed of at least two adjacent elements following a substantially identical pattern. Alternatively, adjacent design elements can be laid on the flexible substrate to form different patterns, e.g., wherein they form the same pattern but one is reversed relative to the other. This fabric design feature and an apparatus and method for achieving it, which can be practiced in conjunction with the present invention, are described respectively in U.S. Pat. No. 3,672,187, particularly at column 1, line 31 through column 3, line 44, and U.S. Pat. No. 3,677,034, particularly at column 1, line 44 through column 8, line 22, which disclosures are incorporated herein by reference.

The improved fabric of the present invention is made possible by a unique process utilizing a novel apparatus in conjunction with stitch-through type machines. The apparatus performs the function, never heretofore achieved, of guiding a plurality of warp yarn design elements onto the flexible substrate in a twisted and aesthetically pleasing configuration at spaced intervals along the warp direction of the fabric as the latter is formed in the work zone of the stitch-through type machine. In its essential features the apparatus comprises at least one shaft rotatable about its longitudinal axis and a guide bar having a row of spaced-apart warp yarn design element guides. The guide bar is joined to the shaft at an angle, preferably so that the row of warp yarn guides lies centered on and at a right angle with respect to the axis of the shaft in response to the rotation of the latter. The warp yarn guides suitable for use on the apparatus must be of a type and gauge which will retain control over the individual warp yarn ends throughout the rotation cycle of the shaft whereby the desired degree of twist is imparted to the design elements corresponding to the degree of angular rotation of the shaft. Such design elements can take the form of orifices or eyelets in the guide bar itself, or looped protuberances resembling yarn guides extending from the guide bar, each orifice, eyelet, or protuberance loop being adapted to permit the passage therethrough of a warp yarn design element, and preferably a single such element.

With respect to its relationship to the overall stitch-through type machine in the case where the warp yarn design elements are laid on the flexible substrate along rectilinear paths, the apparatus of the invention is mounted to the frame of the machine so that the row of design element guides extends as close as possible to the work zone of the machine while retaining its ability to be rotated in response to the rotation of the shaft. In the case where the warp yarn design elements to be twisted are laid on the flexible substrate along non-rectilinear paths, the apparatus is advantageously mounted on the apparatus described in the aforementioned U.S. Pat. No. 3,677,034. A feature of the apparatus, which is described in more detail hereinbelow, is its ability to be linearly and reciprocatingly movable along the longitudinal axis of the shaft to vary the degree of proximity of the row of design element guides to the work zone of the machine, in synchronization with the angular rotation of the shaft. In operation, the shaft is withdrawn from the proximity of the work zone to permit rotation of the guide bar about the axis of the shaft; upon completion of a rotation, the shaft is moved downward toward the work zone and kept there for a pre-determined period of time during which the shaft is not rotated. When it is desired to produce a fabric on a stitch-through type of machine in which a plurality of groups of warp yarn design elements are given a periodic twist configuration, then the apparatus of the invention takes the form of a corresponding plurality of rotatable shaft-guide bar combinations which are mounted on the machine and adapted to be synchronously rotated according to the degree and periodicity of the twist desired to be imparted.

In its broad aspect, the process or method of the present invention includes the steps of (a) delivering a flexible substrate to the above-described work zone of the stitch-through type machine and (b) delivering to the work zone conjointly with and in superimposed relation to the substrate at least two warp yarn design elements. During the course of steps (a) and (b), a plurality of adjacent design elements are twisted, utilizing the above-described apparatus of the invention, at spaced time intervals at a location upstream in the warp direction from the work zone. Finally, the superimposed warp yarn design elements and flexible substrate are bound together at the work zone of the machine by warpwise knitting thread loop chains to form an integrated structure which is the fabric of the present invention in greige form, which is ready for further processing to finished fabric according to art-recognized procedures, e.g., dyeing, drying, resinating, and the like. Even prior to finishing, the fabric of the present invention exhibits an aesthetically pleasing appearance corresponding to the twisted configuration of the design elements.

In practicing the present method, the preferred mode involves imparting a twist of 180° to the design elements at each twist, by corresponding 180° rotation of the shaft of the present apparatus. When viewed over a span of several twists it can be seen that, in the concept of the invention, the direction of angular rotation of the rotating shaft can be made to change sense (i.e., clockwise-to counterclockwise) at every other twist. This feature of the present invention is manifested in the fabric of the invention whereby the twisted design elements within a group exhibit an over-and-over following by an under-and-under configuration along the warpwise direction. In another embodiment the direction of angular rotation of the shaft can be made to change sense with each twist whereby the design elements within a twist-group exhibits a constant over-and-over configuration along the warpwise direction.

In the method of the invention, knitting thread is employed in the manner described hereinabove to form a multiplicity of warpwise loop chains to bind together the design elements and flexible substrate, whether the substrate be one or more layers of knitted (e.g., tricot) or woven fabric, continuous sheeting material including felt or fibrous battings (e.g., continuous filament, carded, cross-weft), and the like, or textile filling elements laid in the weft-wise direction. Usually, alternate loops on each chain are formed with a different knitting thread, and each thread forms a series of warpwise loop chains, preferably in the manner of a half-tricot stitch configuration. The knitting thread pierces the individual design elements and the flexible substrate at a substan-number of random points to further secure the fabric components against relative displacement.

It is a feature of the invention that the present method can be carried out in the manner described above while at the same time guiding the warp yarn design elements back-and-forth in a direction substantially parallel to the rows of stitching elements to thereby cause each design element to move back-and-forth within the elongated work zone past a plurality of needles. Equipment and procedure for imparting this additional design feature to the fabric of the invention are described in the aforementioned U.S. Pat. No. 3,677,034. In using this procedure, the design elements are guided back and forth in reciprocating motion whereby a pattern of design elements is formed on the fabric in which substantial lengths of each design element extend diagonally, relative to the warp direction. For example, the design elements can be guided back and forth at either constant or, more desirably, varying speed, e.g., sinusoidally, so as to form a pattern in which substantial lengths of the design elements are laid on the substrate in a corresponding straight line or, e.g., uniformly, curved fashion. In a further variant, two groups of design elements can be delivered to the elongated work zone and guided back and forth therein independently or in corresponding phased relation to each other, thereby forming a pattern of design elements on the fabric in which the two groups of design elements form different or substantially indentical patterns, respectively. In the former case, one group of design element can be maintained in phased but opposite relation to the other group, whereby a pattern of design element is formed in which the two groups of elements form identical patterns, but one is reversed relative to the other.

BRIEF DESCRIPTION OF THE DRAWINGS

Further details of the present invention and its preferred embodiments can be had by reference to the accompanying drawings wherein.

DESCRIPTION OF THE PREFERRED EMBODIMENTS

In the following description, the corresponding elements as shown in each figure of the drawings are given the same reference number, and letter suffixes are added to designate specific ones of these elements where necessary.

Figure 1:
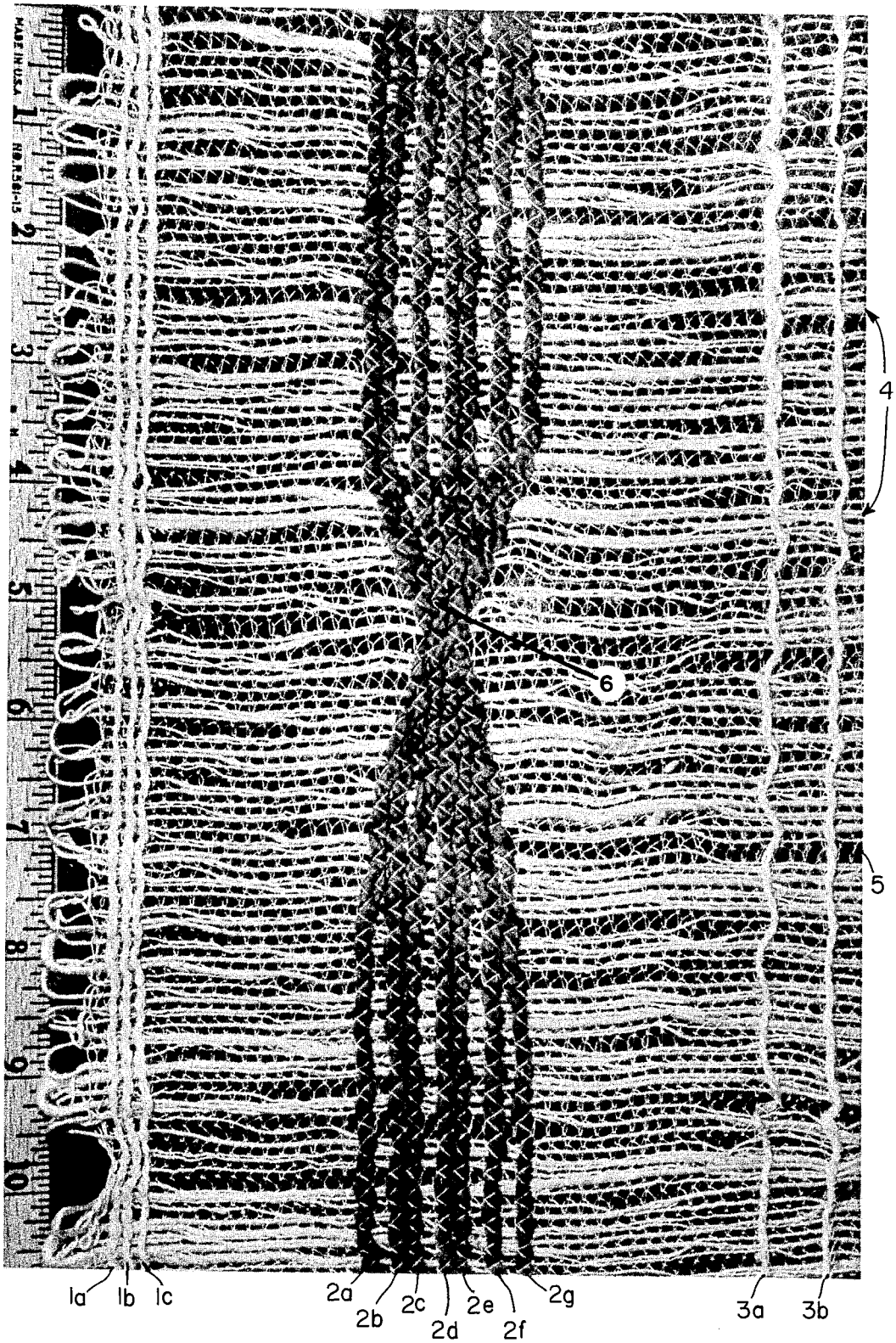
FIG. 1 is a photograph of a portion of a textile fabric of the present invention showing the ornamental effect achieved by the twisted configuration of a plurality of warp yarn design elements.

In the embodiment shown in the photograph of FIG. 1, wherein the scale at the left is graduated in inches, design yarn elements or ends 1*a*–1*c*, 2*a*–2*g*, and 3*a*, 3*b* are laid on a flexible substrate composed of a layer of spaced-apart textile fillings or weft elements 4 to provide a fabric. The warp yarn elements and filling elements are secured in their relative positions by means of knitting thread 5 which forms parallel rows of warpwise loop chains. Warp yarn elements 2*a*–2*g* are also referred to as "design elements" by virtue of their 180° symmetrically twisted configuration on the fabric at 6 to provide an aesthetically pleasing appearance characteristic of the present invention.

Figure 2:
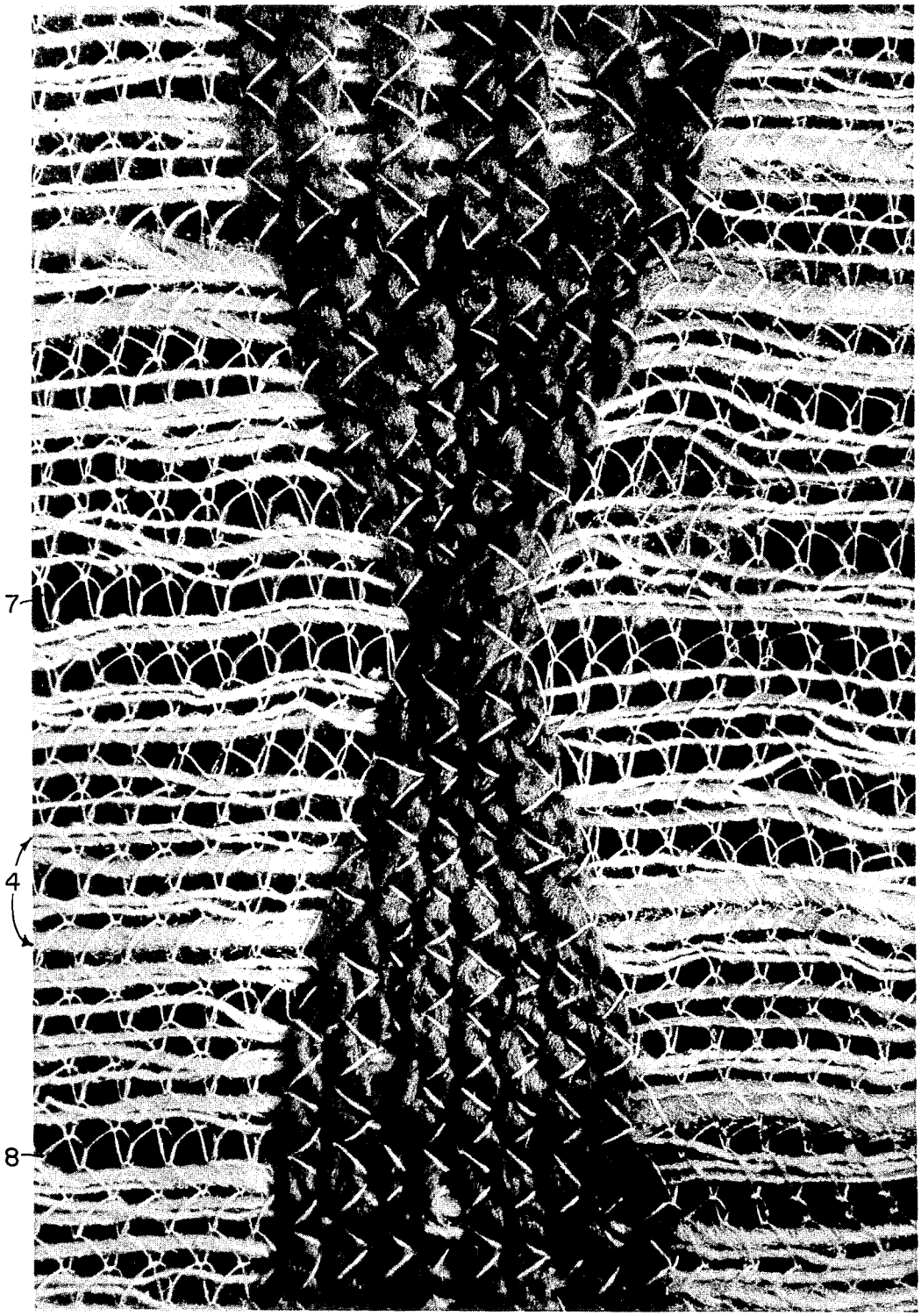
FIG. 2 is a photograph of an enlarged view of that portion of the fabric in FIG. 1 where the warp yarn design elements are twisted on the flexible substrate.
Figure 3:
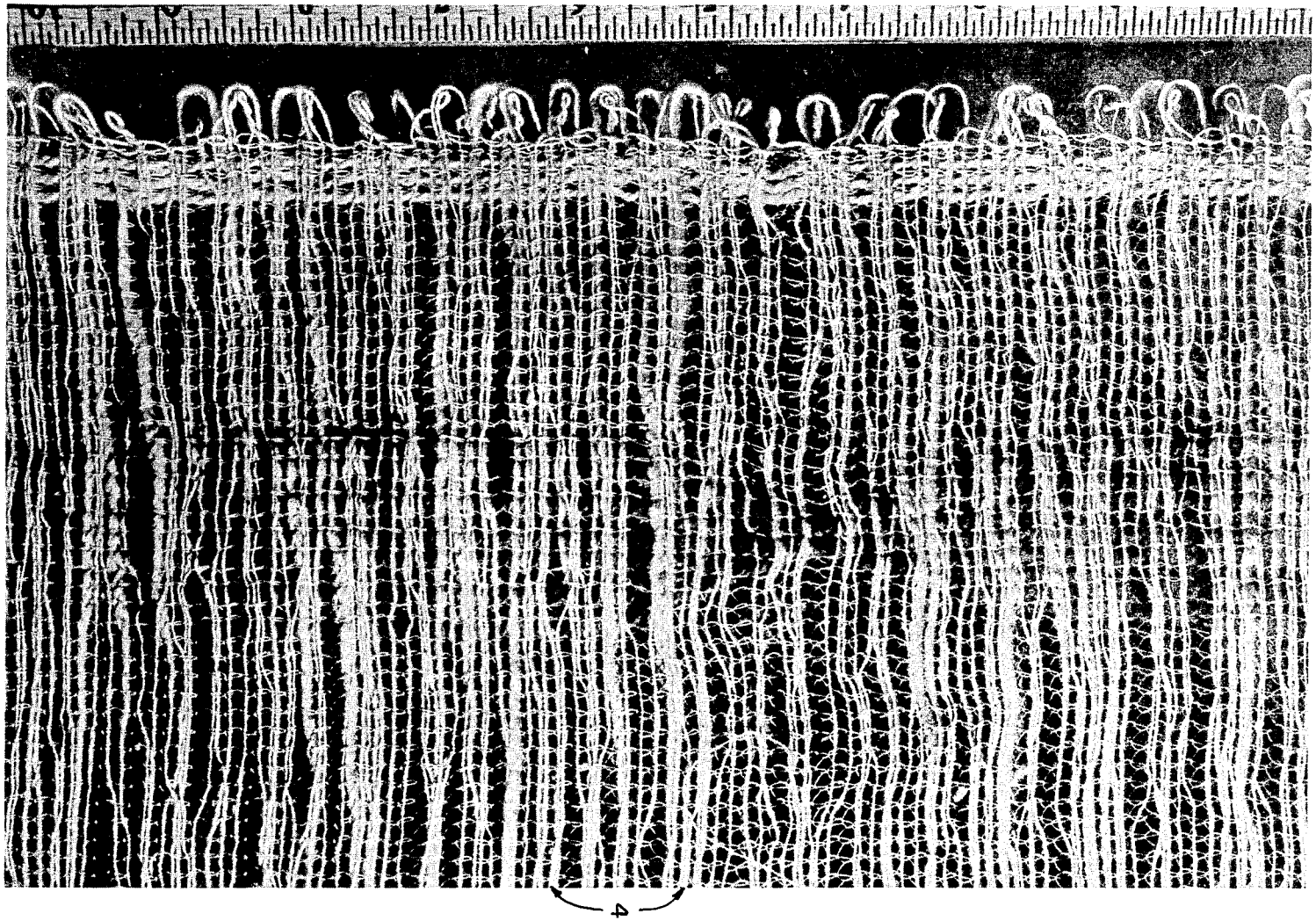
FIG. 3 is a photograph of the fabric in FIG. 1 as viewed from the underside.

FIG. 2 more clearly shows the manner in which the warp yarn elements and the filling elements are secured in their relative positions by means of knitting threads which form parallel rows of warpwise loop chains 7 and diagonally extending portions 8 which cross between adjacent loop chains. Each pair of adjacent loop chains shares two knitting threads, alternate loops of each chain being parts of a first thread and the running loopes being from a second thread, in the form of a half tricot stitch. The textile filling elements 4 of the flexible substrate are engaged and held on the back side of the fabric by the loops of the tricot stitch as shown in FIG. 3 and on the front side by the diagonal parts of the tricot stitch, as shown in FIG. 2. In this way, the knitting threads lock the warp yarn and flexible substrate components of the fabric in position relative to one another to form an integral structure.

Figure 4:
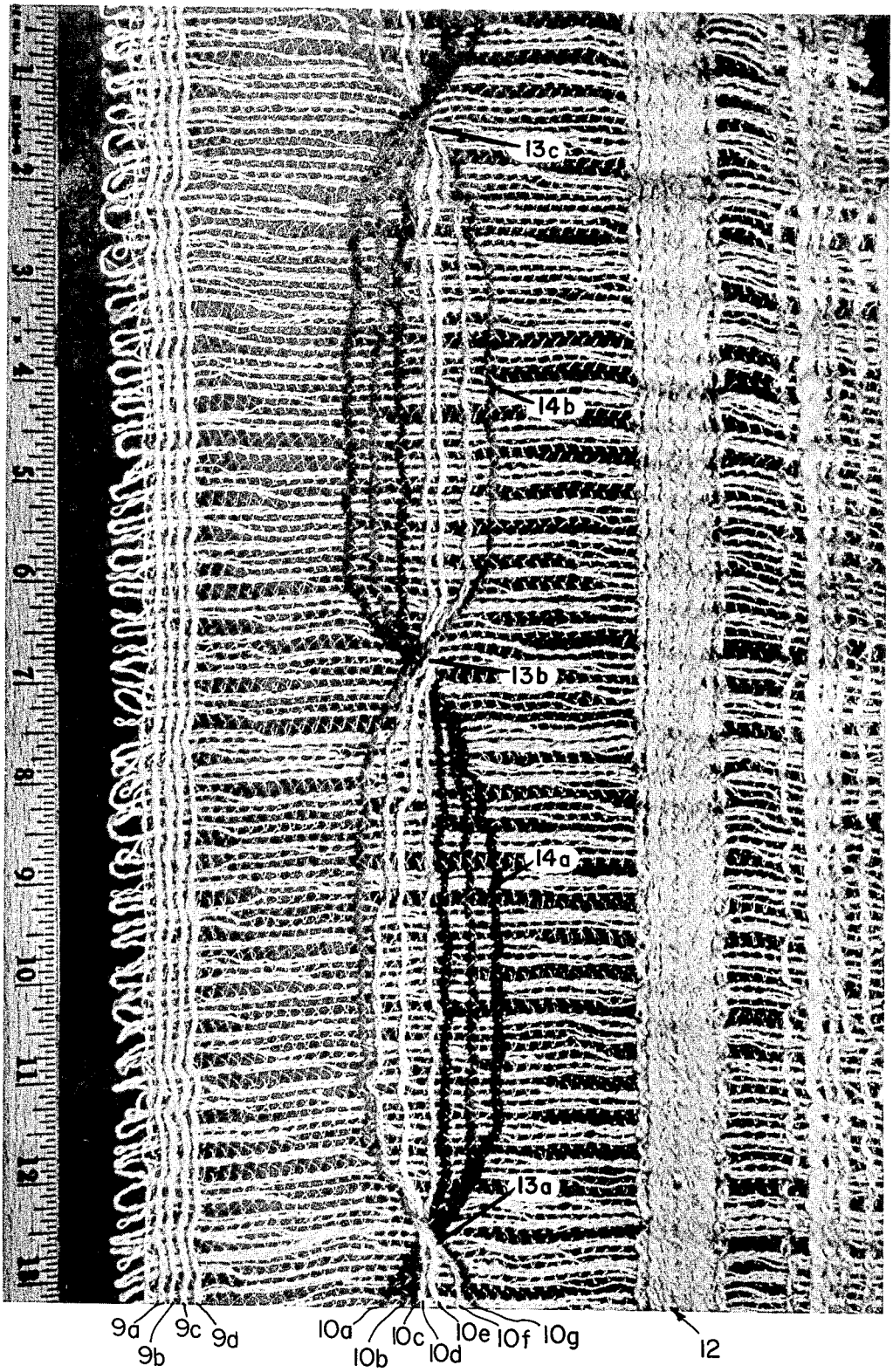
FIG. 4 is a photograph of a portion of another textile fabric of the present invention showing the ornamental and aesthetically pleasing effect achieved by the twisted configuration of a number of differently-colored warp yarn design elements.
Figure 5:
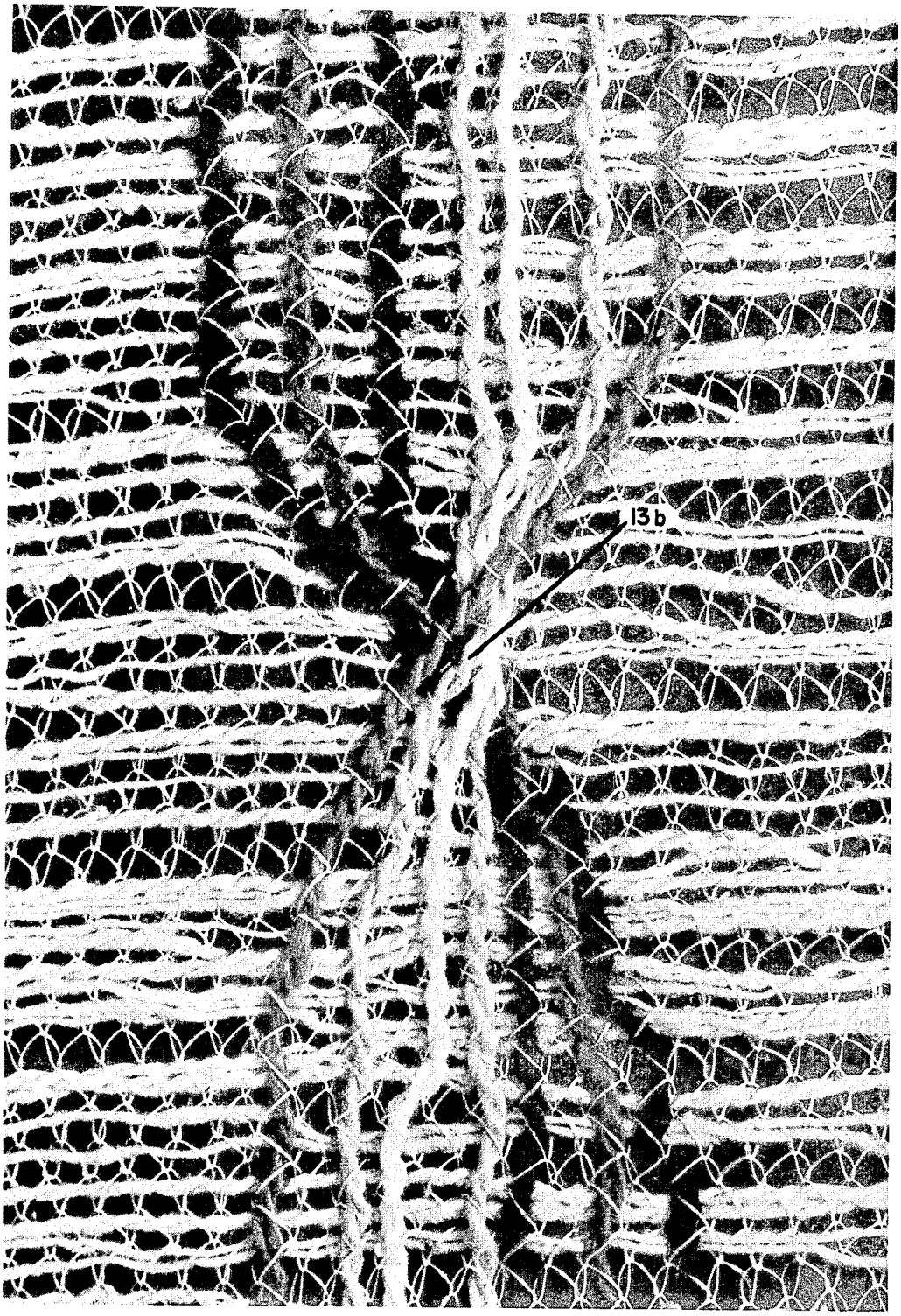
FIG. 5 is a photograph of an enlarged view of a portion of the fabric in FIG. 4 where the warp yarn design elements are twisted on the flexible substrate.

In the embodiment shown in FIG. 4, wherein the scale at the left is graduated in inches, warp yarn elements 9*a*–9*b* and 10*a*–10*b* are laid, substantially spaced apart from one another in the weft direction, on a substrate layer of spaced-apart textile filling elements 11; warp yarn elements 12 are laid on the substrate in mutually contacting relationship. Multi-colored yarn elements 10*a*–10*g* are also referred to as "design elements" by virtue of their 180° symmetrically twisted configuration at 13*a*, 13*b* and 13*c* between spaced intervals 14*a* and 14*b*. The symmetrical nature of the 180° twist of the design elements, for example at 13*b*, wherein opposite design elements exchange places with each other is more fully brought out in FIG. 5. The attractive over-and-over/under-and-under configuration of design elements 10*a*–10*g* along the warp-wise direction can be readily appreciated by reference to FIG. 4. This effect is achieved by the reversal in the direction of angular rotation with every other twist of the rotating shaft of the apparatus of the invention.

Figure 6:
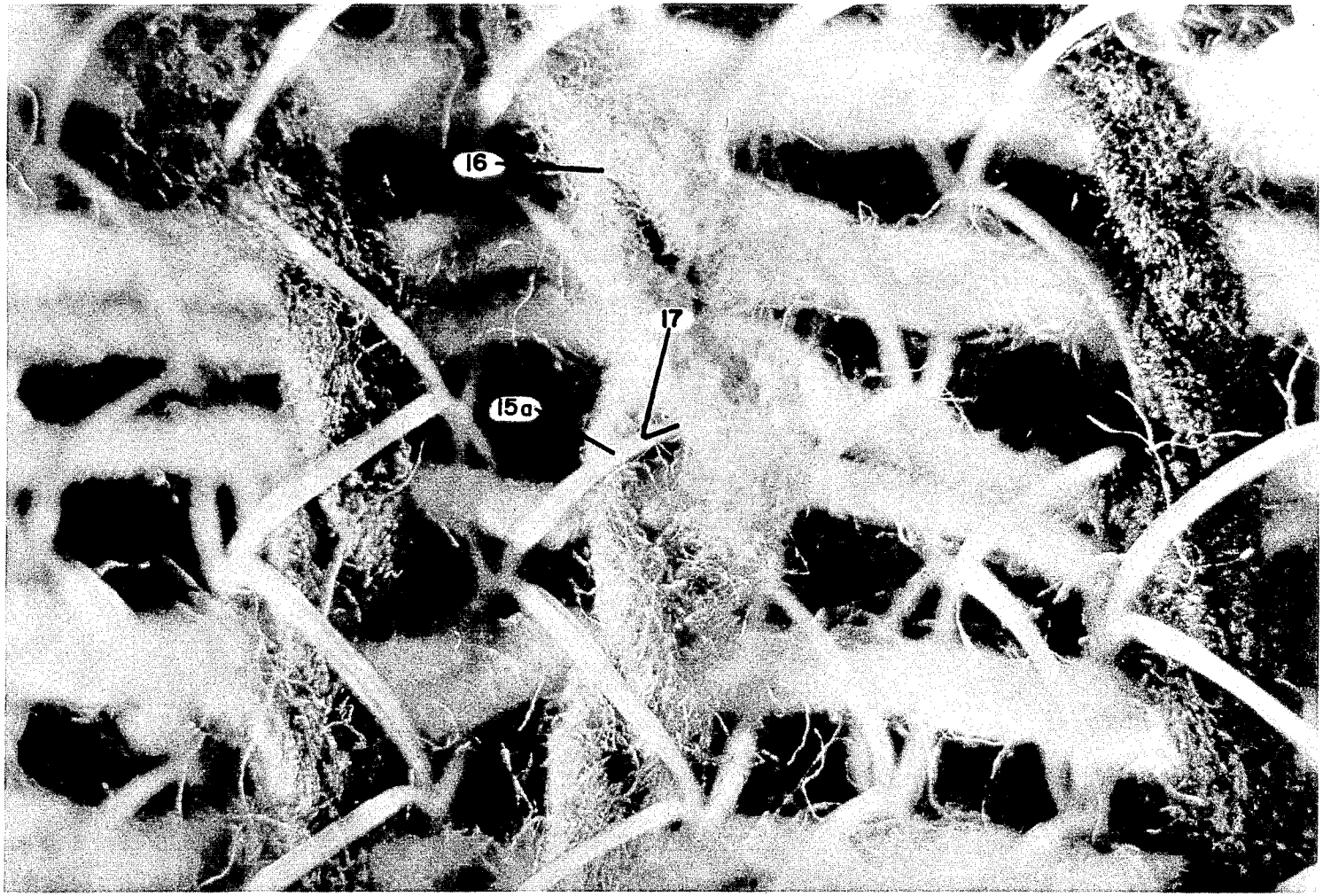
FIG. 6 is a photograph of a greatly magnified portion of the fabric in FIG. 4 wherein the knitting thread pierces a design element to further secure it against displacement relative to the substrate.
Figure 7:
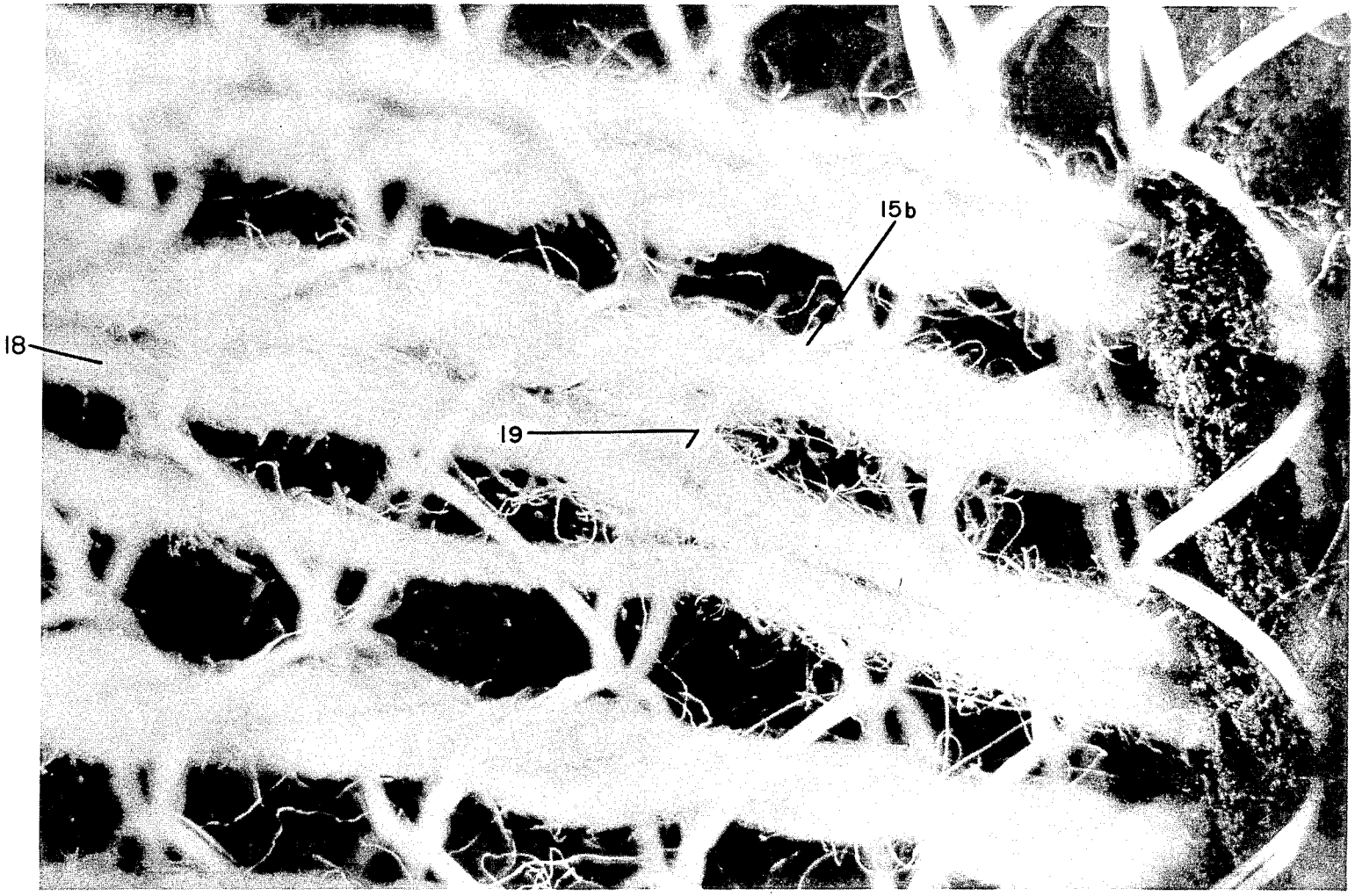
FIG. 7 is a photograph of a greatly magnified portion of the fabric in FIG. 4 wherein the knitting thread pierces the substrate to further secure it against displacement relative to the design elements.

FIG. 6 dramatically shows a knitting thread 15*a* piercing a warp yarn design element 16 of the fabric in FIG. 4 at one of a substantial number of random points 17 to further secure the substrate and design elements against relative displacement. Likewise, FIG. 7 illustrates how a knitting thread 15*b* pierces a textile filling element 18 of the flexible substrate of the fabric in FIG. 4 at one of a substantial number of random points 19.

Figure 8:
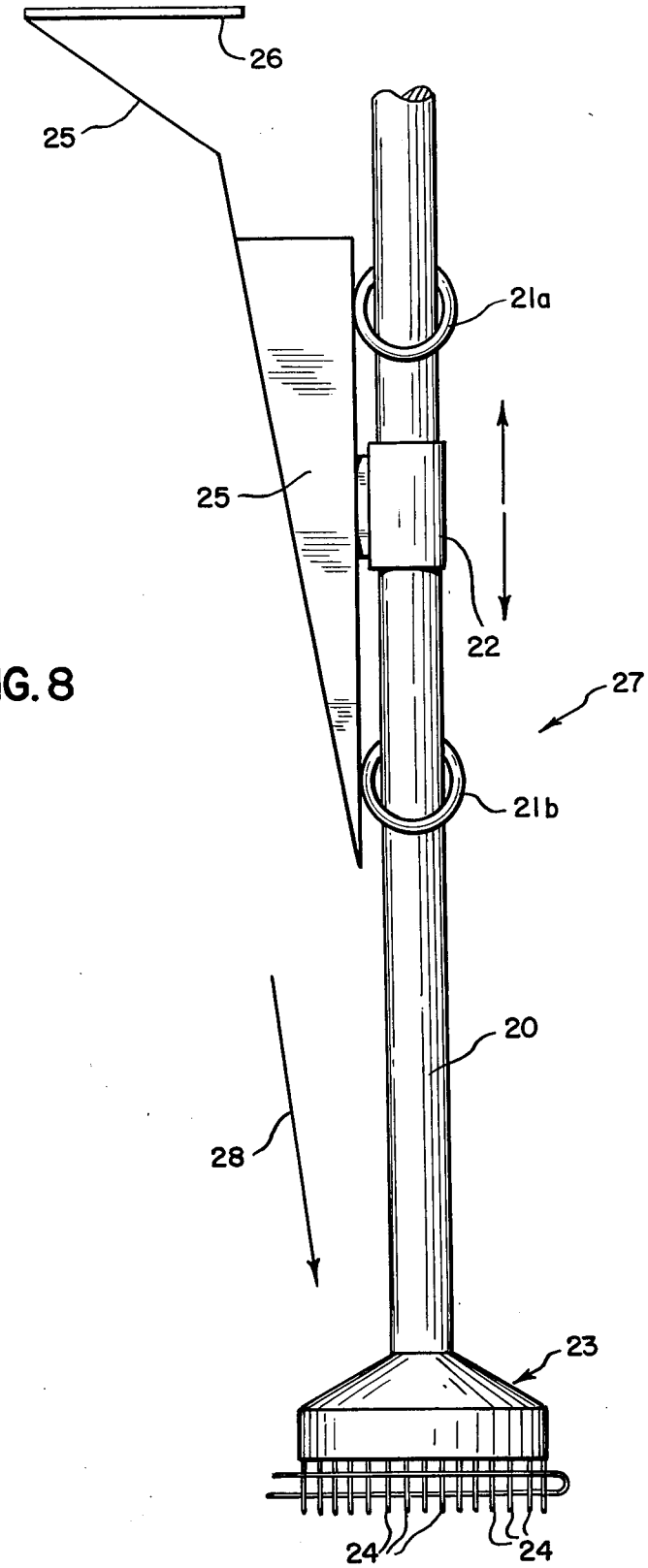
FIG. 8 is a partially schematic view of an embodiment of the apparatus of the present invention.

Referring to apparatus 27 illustrated in FIG. 8, shaft 20 is adapted to be rotated about its longitudinal axis within at least one and preferably two or more ball bushings 21*a* and 21*b* by a conventional rotary drive means (not shown). The shaft 20 is also adapted to be linearly and reciprocatingly movable along the direction of its longitudinal axis within linear bearing 22 of a type which can be readily purchased from commercial suppliers, e.g., the Barden Corp., Danbury, Conn. Attached to shaft 20 is design element guide bar 23 having a plurality of spaced-apart warp yarn design element guides 24 which form a straight row that preferably intersects the longitudinal axis of the shaft at a right angle at the center or mid-point of the row, as shown. The angle at which the row of design element guides 24 intersects the axis of shaft 20 denotes the angle at which the guide bar 23 is attached to the shaft. Angles of attachment other than 90° and/or at points other than the middle of the row can be employed for somewhat different twist effects, e.g., to obtain a "lop-sided" or non-symmetrical twist. The guides 24 are represented schematically in FIG. 8, it being understood that any guides of the type heretofore used on Malimo machines generally and consistent with the operation of the apparatus of the invention can be used, including close-looped protuberances, open-looped wires or "pigtails", formina drilled into the guide bar itself, and the like. The number of individual guides constituting the row determine the "gauge" of the apparatus, which is attached to the frame of the Malimo machine at 26 by means of mounting bracket 25.

In the operation of a Malimo machine to which the present apparatus has been mounted for making the fabric of the invention, the shaft 20 of the apparatus, which is perpendicular to the elongated work zone, is withdrawn a short distance from the zone along its axis and then rotated, say 180°, and then pushed back down toward the stitching elements (needles) in the work zone to complete the "cross-over" in a predetermined number of stitches. The shaft is then held in the "down" position for the desired number of stitches corresponding to the interval along the warp direction of the fabric between twists. During this time the row of design element guides on the guide bar are maintained substantially parallel to the elongated work zone. When the next "flip-flop" is desired to take place, the shaft is withdrawn from the proximity of the work zone as before so that the guide bar can be clear of the flexible substrate being continuously fed to the work zone and rotated about the shaft axis without interfering with the substrate. It is a feature of the invention that the reciprocal "up-and-down" motion of the shaft of the present apparatus serves the added function of pushing a newly-formed "twist" back down toward the work zone and as close as possible to the stitching needles more quickly, thereby imparting a cleaner, more abrupt and visually more pleasing appearance to the twist configuration of the design elements. The location and direction of travel of the design yarn elements with respect to the apparatus 27 is depicted by arrow 28.

Figure 9:
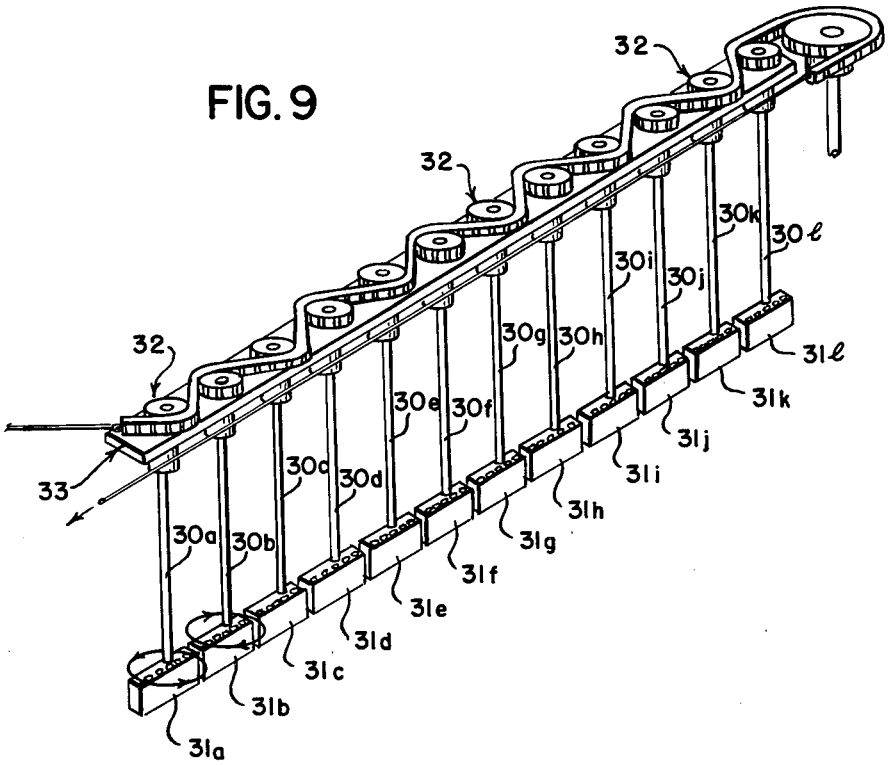
FIG. 9 is a partially schematic perspective view of another embodiment of the apparatus of the invention.

With reference to FIG. 9, there is illustrated, in partial schematic, a variant of the apparatus of the invention in which a plurality of parallel shafts 30*a*–30*z*, each with a corresponding guide bar 31*a*–31*z* joined thereto, are synchronously rotatably mounted on a Malimo machine (not shown). The synchronous rotation of the shafts is accomplished in this embodiment by means of chain drive 32 which operates in synchronization with the reciprocating linear movement of the shafts along their parallel axes. The reciprocal motion of the shafts is provided by a linear drive means (not shown) which operates on the apparatus through frame or girt 33. Both the rotary and reciprocal drive means discussed in connection with FIG. 9 are illustrative and can be varied by those skilled in the art using conventional drive train techniques. The rotatable guide bars 31*a*–31*z* are shown with orifices to permit the passage therethrough of the warp yarn design elements. The number of shaft-guide bar combinations employed on the apparatus determines the number of groups of warp yarn design elements that are laid on the flexible substrate in a twisted configuration.

The foregoing examples are presented for the purpose of illustrating the invention and its advantages without limitation to specific features or embodiments. It is understood that changes and variations can be made in the fabric, apparatus and method of the invention without departing from the scope thereof which is defined in the following claims.

We claim:

1. An apparatus for guiding a plurality of warp yarn design elements onto a flexible substrate in a twisted and aesthetically pelasing configuration at spaced intervals along the warp direction in a stitch-through type machine such as a Malimo machine, comprising:

a shaft rotatable about its longitudinal axis and linearly movable in the direction of said axis; and a guide bar having a plurality of spaced-apart warp yarn design element guides joined to the shaft at an angle and rotatable with the shaft about the axis, said apparatus being adapted to be mounted on the machine and rotatably disposed with respect to the longitudinal axis of the shaft.

2. An apparatus according to claim 1 wherein the guide bar is centered on and joined to the shaft at a right angle.

3. An apparatus according to claim 2 wherein the spaced guides are orifices in the guide bar, each orifice being adapted to permit the passage therethrough of a warp yarn design element.

4. An apparatus according to claim 2 wherein the spaced guides are looped protuberances extending from the guide bar, each protuberance being adapted to permit the passage through its loop of a yarn design element in warp direction.

5. An apparatus according to claim 1 wherein a plurality of shafts, each with a guide bar joined thereto, are adapted to be synchronously rotatably mounted on the machine.

6. A method for forming a stitch bonded type fabric on a stitch-through type machine such as a Malimo machine having a comb-like sinker bar, a comb-like retainer pin bar, the sinker bar and the retainer pin bar defining an elongated work zone for fabric formation between them, a row of pronged needles reciprocatingly movable through said zone and a row of knitting thread guides co-acting with the needles for forming a multiplicity of warpwise knitting thread loop chains, comprising the steps of:

(a) delivering a flexible substrate to the elongated work zone;

(b) delivering conjointly with and in superimposed relation to the substrate at least two yarn design elements to the work zone in the warp direction;

(c) twisting a plurality of adjacent design elements at spaced time intervals at a location upstream in the warp direction from the work zone; and (d) forming a series of warpwise knitting thread loop chains to bind together the substrate and design elements at the work zone into an integrated structure having an aesthetically pleasing appearance corresponding to the twisted configuration of said design elements.

7. A method according to claim 6 wherein the design elements are substantially spaced apart and are symmetrically twisted at 180° at each twist interval in step (c).

8. A method according to claim 7 wherein alternate loops in each chain are formed in step (d) with a different knitting thread, and each thread forms a series of warpwise loop chains.

9. A method according to claim 8 wherein the knitting thread pierces the flexible substrate and pierces the individual design elements in step (d) at a substantial number of random points to further secure the substrate and design elements against relative displacement.

10. The method according to claim 9 wherein the knitting thread is applied in step (d) as a half-tricot stitch.

11. The method according to claim 6 wherein the flexible substrate is a knitted fabric.

12. The method according to claim 6 wherein the flexible substrate is a woven fabric.

13. The method according to claim 6 wherein the flexible substrate is a continuous sheeting material selected from the group consisting of elastomeric foam sheet and fibrous batting.

14. The method according to claim 6 wherein the flexible substrate is at least one layer of textile filling elements.

15. The method according to claim 9 wherein the flexible substrate is at least one layer of textile filling elements.

16. A method for forming a stitch bonded type fabric on a stitch-through type machine such as a Malimo machine having a comb-like sinker bar, a comb-like retainer pin bar, the sinker bar and the retainer pin bar defining an elongated work zone for fabric formation between them, a row of needles reciprocatingly movable through said zone and a row of knitting thread guides co-acting with the needles for forming a multiplicity of warpwise knitting thread loop chains, comprising the steps of:

(a) delivering a flexible substrate to the elongated work zone;

(b) delivering conjointly with and in superimposed relation to the substrate at least two yarn design elements to the work zone in the warp direction;

(c) twisting a plurality of adjacent design elements at spaced time intervals at a location upstream in the warp direction from the work zone, while guiding the design elements back and forth substantially parallel to the row of needles to cause each design element to move within the elongated work zone back and forth past a plurality of needles; and (d) forming a series of warpwise knitting thread loop chains to bind together the substrate and design elements at the work zone into an integrated structure having an aesthetically pleasing appearance corresponding to the twisted configuration of said design elements in combination with the non-rectilinear disposition of the warp yarn design elements.

17. A method according to claim 16 wherein the design elements are substantially spaced apart and are summetrically twisted 180° at each time interval in step (c).

18. A method according to claim 17 wherein:

alternate loops in each chain are formed in step (d) with a different knitting thread, each thread forming a series of warpwise loop chains; and the knitting thread pierces the flexible substrate and pierces the individual design elements in step (d) at a substantial number of random points to further secure the substrate and design elements against relative displacement.

19. A method according to claim 18 wherein the knitting thread is applied in step (d) as a tricot stitch.

20. A method according to claim 18 wherein the flexible substrate is selected from the group consisting of knitted fabric, woven fabric, elastomeric foam sheet and a layer of textile filling elements.

21. A method according to claim 20 wherein the design elements are guided back and forth in reciprocating motion at constant velocity in step (c), thereby forming a pattern of design elements on the fabric in which substantial lengths of each element extend diagonally, relative to the warp direction, along straight lines.

22. A method according to claim 20 wherein the design elements are guided back and forth in reciprocating motion at a varying velocity in step (c), thereby forming a pattern of design elements on the fabric in which substantial lengths of each design element are uniformly curved.

23. A method according to claim 20 wherein two groups of design elements are delivered to the elongated work zone in step (b) and are guided back and forth in step (c) in corresponding phased relation to each other, thereby forming a pattern of design elements on the fabric in which the two groups of design elements form substantially identical patterns.

24. A method according to claim 20 wherein two groups of design elements are delivered to the elongated work zone in step (b) and are guided back and forth independently of each other, thereby forming a pattern of design elements on the fabric in which the two groups of design elements form different patterns.

25. A method according to claim 24 wherein one group of design elements is guided back and forth in step (c) in opposed and phased relation to the other group of design elements.

* * * * *

UNITED STATES PATENT AND TRADEMARK OFFICE

CERTIFICATE OF CORRECTION

PATENT NO. 4,192,160

DATED March 11, 1980

INVENTOR(S) : DANIEL DUHL and DENTON B. WALL

It is certified that error appears in the above-identified patent and that said Letters Patent are hereby corrected as shown below:

[57] ABSTRACT, line 2, "maching" should read -- machine -- .

Column 2, line 39, "0°C" should read -- 0° -- .

Column 3, line 45, "symergistically" should read

-- synergistically -- .

Column 5, lines 42-43, "substan-number" should read

-- substantial number -- .

Column 6, line 4, "element" should read -- elements -- .

Column 6, line 6, "element" should read -- elements -- .

Column 7, line 3, "loopes" should read -- loops -- .

Column 7, line 66, "formina" should read -- foramina -- .

Column 8, line 66, "pelasing" should read -- pleasing -- .

UNITED STATES PATENT AND TRADEMARK OFFICE

CERTIFICATE OF CORRECTION

PATENT NO. : 4,192,160

DATED : March 11, 1980

INVENTOR(S) : DANIEL DUHL and DENTON B. WALL

It is certified that error appears in the above-identified patent and that said Letters Patent are hereby corrected as shown below:

Column 10, line 42, "summetrically" should read

-- symetrically -- .

Signed and Sealed this

*Twenty-ninth* Day of *July 1980*

[SEAL]

*Attest:*

SIDNEY A. DIAMOND

*Attesting Officer* *Commissioner of Patents and Trademarks*